US007451696B2

(12) United States Patent
Kott et al.

(10) Patent No.: US 7,451,696 B2
(45) Date of Patent: Nov. 18, 2008

(54) PRESS UNIT FOR A MANUFACTURED WOOD PRODUCT PRESS

(75) Inventors: Norbert Kott, Ft. Langley (CA); Steven Rempel, Langley (CA); Orlando C. Janzen, Port Coquitlam (CA); Ayodele Adeleye, Langley (CA); Edmond Tam, Burnaby (CA); James Cheng, Langley (CA)

(73) Assignee: Weyerhaeuser Company, Federal Way, WA (US)

( * ) Notice: Subject to any disclaimer, the term of this patent is extended or adjusted under 35 U.S.C. 154(b) by 26 days.

(21) Appl. No.: 11/236,993

(22) Filed: Sep. 28, 2005

(65) Prior Publication Data

US 2007/0068400 A1 Mar. 29, 2007

(51) Int. Cl.
*B30B 7/00* (2006.01)

(52) U.S. Cl. ..... 100/233; 100/280

(58) Field of Classification Search ..... 100/233, 100/240, 245, 280
See application file for complete search history.

(56) References Cited

U.S. PATENT DOCUMENTS 6,477,945 B1 * 11/2002 Imanishi et al. ..... 100/264
6,662,715 B2 * 12/2003 Kanamaru et al. ..... 100/282
6,989,116 B2 * 1/2006 Kott ..... 264/69
7,115,223 B2 * 10/2006 Pugel et al. ..... 264/68

* cited by examiner

*Primary Examiner*—Shelley Self
(74) *Attorney, Agent, or Firm*—Christensen O'Connor Johnson Kindness

(57) ABSTRACT

A press unit (20) for a manufactured wood press (60) is provided. The press unit includes a housing (80), a platen (90), and a drive assembly (76) disposed within the housing. The drive assembly is coupled to the platen to drive the platen in a non-linear motion. More specifically, the drive assembly includes a shaft having concentric and eccentric portions which are disposed on separate axes. Rotation of the eccentric portion about its respective axis causes movement of the platen in the non-linear motion.

15 Claims, 8 Drawing Sheets

PRESS UNIT FOR A MANUFACTURED WOOD PRODUCT PRESS

FIELD OF THE INVENTION

The described embodiments relate generally to engineered wood products and, more specifically, to a drive assembly for a manufactured wood products press.

BACKGROUND OF THE INVENTION

Orientated strand board ("OSB"), parallel strand board lumber and other engineered wood products are formed by layering strands (flakes) of wood in specific orientations. Such manufactured wood products are typically manufactured in wide mats from cross-orientated layers of thin, rectangular wooden strips compressed and bonded together with wax and resin adhesives (95% wood, 5% wax and resin). These strips are created by shredding wood into strips, which are sifted and then orientated on a belt. The mat is made in forming a bed, the layers are built up with external layers aligned in the panel direction and internal layers randomly positioned. The number of layers placed is set by the required thickness of the finished panel. The mat is then placed in a thermal press system.

As depicted in FIG. 1, current press systems include a pair of opposed platens 40*a* configured to continuously compress a material 38*a* into a desired shape. Adjacent each platen 40*a* is a press belt 37 running on a roller arrangement 35. The belt 37 and roller arrangement 35 combination allows movement of the material 38*a* through the platens 40*a* while the platens are continuously applying a compressive force to the material 38*a*. Although such thermal press systems are effective at forming engineered wood products, they are not without their problems. As a non-limiting example, such systems typically use a single platen. As such, very large sections of the platens must be removed when they must be replaced.

Thus, there exists a need for a press unit for a manufactured wood product press.

SUMMARY OF THE INVENTION

In accordance with certain embodiments of the present invention, a press unit for a manufactured wood products press is provided. The press unit includes a housing, a platen, and a drive assembly disposed within the housing and coupled to the platen to drive the platen in a non-linear motion. In accordance with further aspects of this embodiment, the drive assembly has a drive mechanism that includes a shaft having at least one concentric portion and at least one eccentric portion disposed along a length of the shaft.

A press unit for a manufactured wood product press constructed in accordance with another embodiment of the present disclosure includes a platen and first and second drive assemblies coupled to the platen. The first and second drive assemblies each include a housing and a drive mechanism disposed within the housing. The drive mechanism includes at least one concentric portion and at least one eccentric portion for driving the platen in at least a non-linear motion.

A press unit for a manufactured wood products press constructed in accordance with yet another embodiment of the present disclosure includes a housing, a platen, and a drive assembly disposed within the housing. The drive assembly includes a drive mechanism having alternating eccentric and concentric portions. The drive mechanism is coupled to the platen to drive the platen relative to the housing in a non-linear motion.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
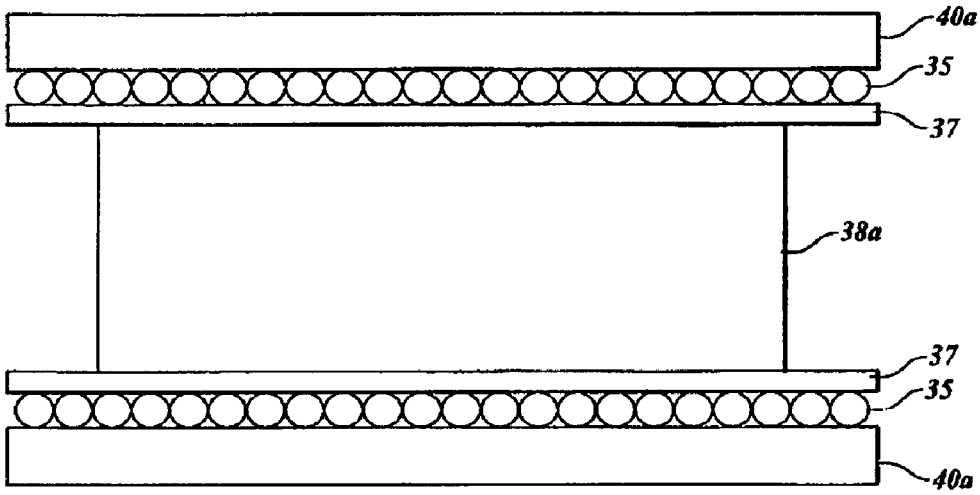
Fig.1. (PRIOR ART)
FIG. 1 is a side planar view of a prior art manufactured wood product press.
Figure 2:
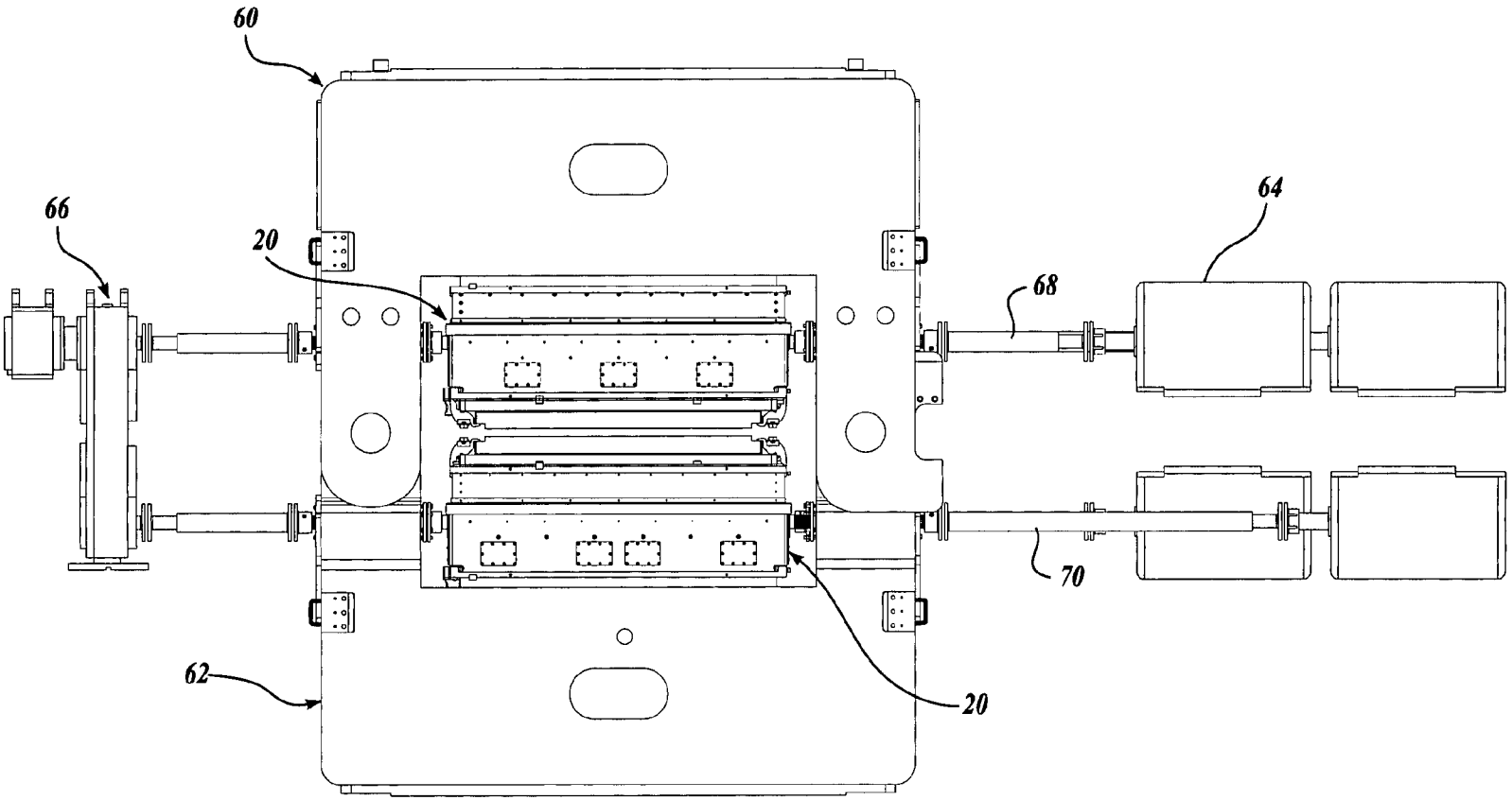
FIG. 2 is an end planar view of a manufactured wood product press incorporating a press unit constructed in accordance with one embodiment of the present invention.

FIG. 2 illustrates a press unit 20 constructed in accordance with one embodiment of the present invention. The press unit 20 is shown as it would be used with a manufactured wood products press 60. Note that the manufactured wood products press 60 is suitably a well-known press used in producing manufactured wood products, such as OSB. As such, it is provided for illustrative purposes to place the press unit 20 in an anticipated environment of use and description of the press 60 is limited only to establish such an environment of use.

The manufactured wood products press 60 includes a frame 62, drive motors 64, and a gear box 66. The manufactured wood products press 60 suitably includes two press units 20 disposed within the frame 62 in an opposed manner. As positioned within the frame 62, each press unit 20 counteracts the other during operation of the manufactured wood products press 60 to produce a wide variety of manufactured wood products. The production of such manufactured wood products is well-known in the art and is not detailed for conciseness.

Individual press units 20 are actuated by rotating crank shafts 68 and 70 that are driven by the drive motors 64. The press units 20 are operated in a precisely coordinated manner, e.g., such that the drive shafts 68 and 70 are rotationally in phase and are partially controlled by the gear box 66.

Although two press units 20 are illustrated, it should be apparent that the appended claims are not intended to be so limited. As a non-limiting example, the manufactured wood products press 60 may include only one press unit 20 positioned to be actuated against a fixed, opposing surface. Thus, manufactured wood products presses 60 having more or less press units 20 are also within the scope of the present disclosure.

Figure 3:
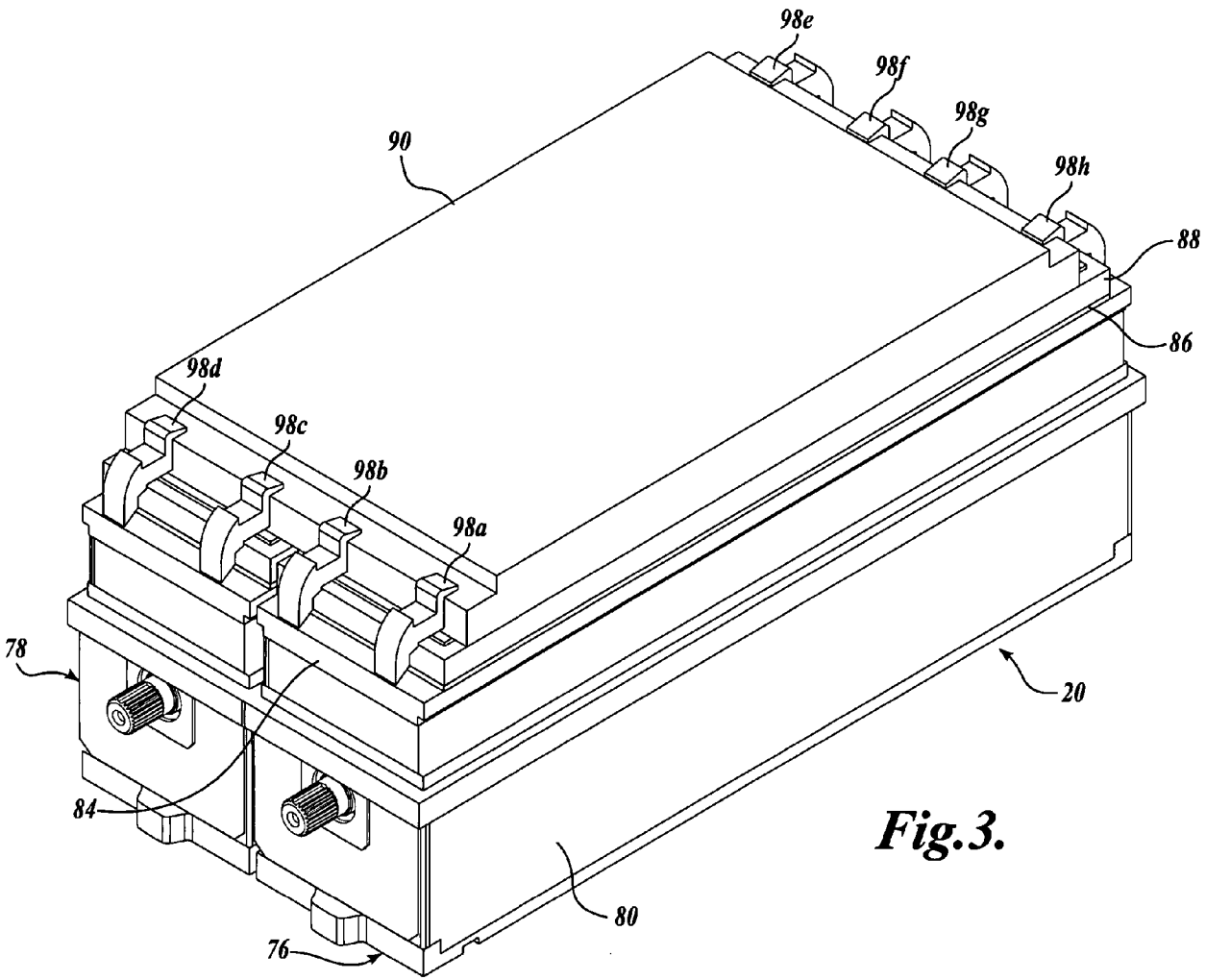
FIG. 3 is an isometric view of a press unit constructed in accordance with one embodiment of the present invention.
Figure 4:
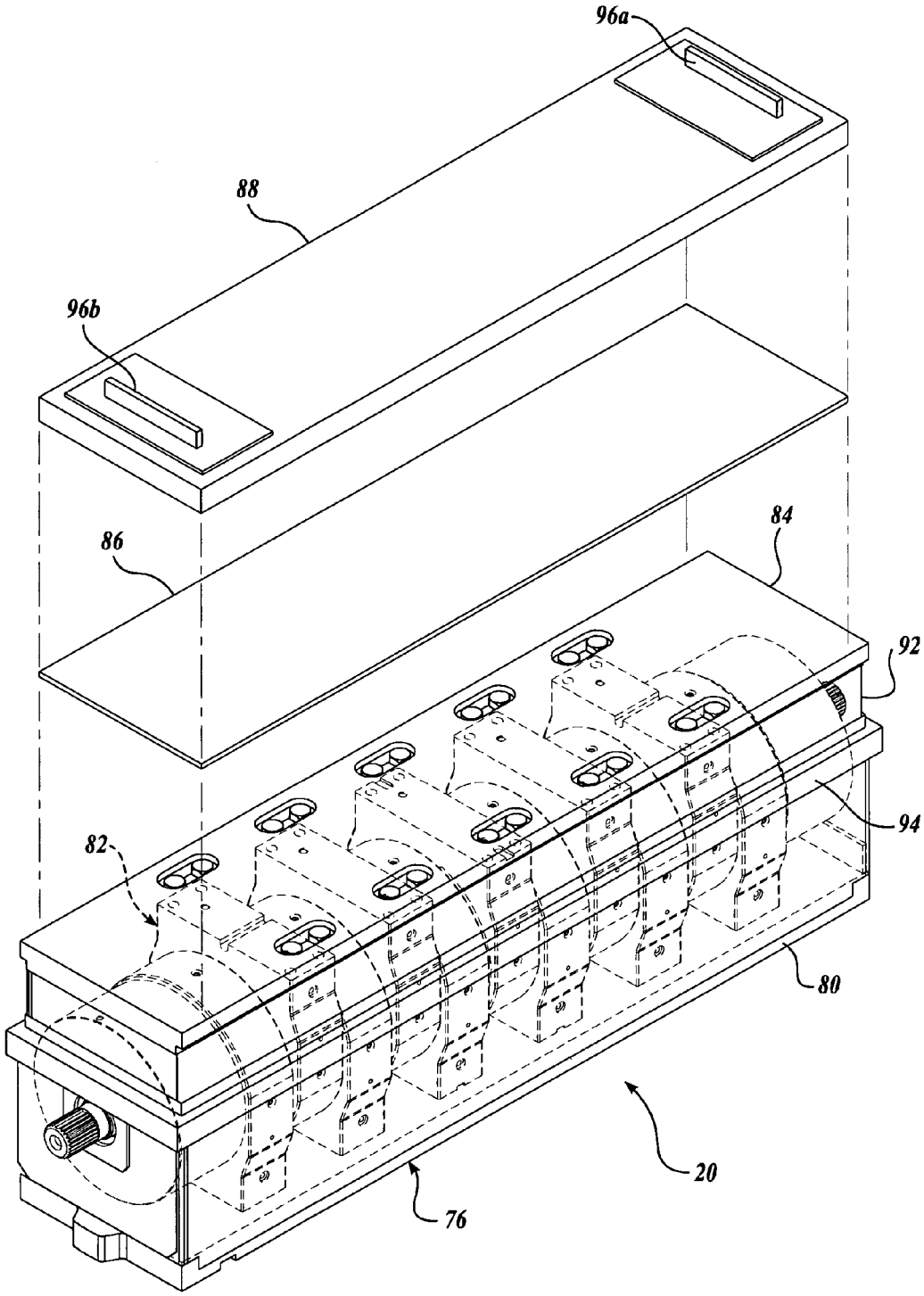
FIG. 4 is an isometric, partially exploded view of a drive assembly for the press unit of FIG. 3.
Figure 5:
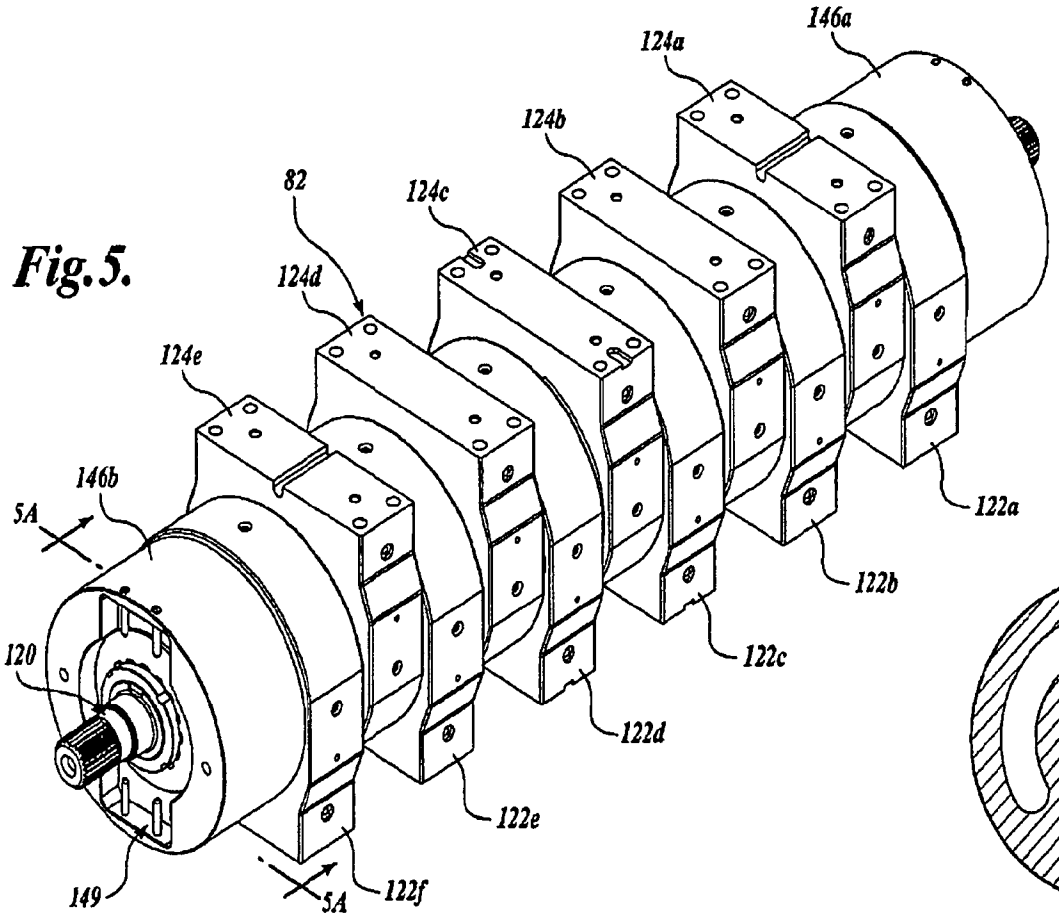
FIG. 5 is an isometric view of a drive mechanism constructed in accordance with one embodiment of the present invention and usable in the drive assembly of FIG. 4.

The press unit 20 may be best understood by referring to FIGS. 3-5. The press unit 20 suitably includes first and second drive assemblies 76 and 78. Although the press unit 20 is illustrated as including two drive assemblies 76 and 78, it should be apparent that other press units having more or less drive assemblies are also within the scope of the present invention. As an example, a press unit with only one drive assembly or one having three or more drive assemblies is within the scope of the present invention. Also, because each drive assembly is identically configured, only one drive assembly will be described in greater detail. However, the description of one drive assembly is equally applicable to all drive assemblies of similar construction.

The drive assembly 76 includes a housing 80, a drive mechanism 82, a conversion plate 84, and an insulation layer 86. The drive assembly 76 also includes a key plate 88 and a platen 90. The housing 80 is suitably configured to house the drive mechanism 82 in a bath of lubricant, such as oil (not shown). Although the press unit 20 is illustrated as having two separate housing, other embodiments, such as a press unit having a single housing, are also within the scope of the present disclosure.

As may be best seen by referring to FIG. 4, the conversion plate 84 is suitably attached to a portion of the drive mechanism 82. A lower surface of the conversion plate 84 includes a downwardly extending an oil shield 92. The oil shield 92 is sized to be sealingly engaged with an upper end 94 of the housing 80. During operation of the press unit, the oil shield 92 reciprocates or slides within the upper end 94 of the housing 80. As configured, the oil shield seals the bath of lubricants disposed within the housing 80 and permits the drive mechanism 82 to be driven by the drive motors 64 in a manner described in greater detail below.

Still referring to FIG. 4, the insulation layer 86 is sandwiched between an upper surface of the conversion plate 84 and a lower surface of the key plate 88. The sandwiched assembly is attached to the drive assembly 76 by well-known fasteners, such as bolts. The well-known platen 90 is fastened, at least in part, to the key plate 88 by a pair of attachment keys 96*a* and 96*b* lockingly engaging a corresponding notch (not shown) located in a lower surface of the platen 90. To further secure the platen 90 to the drive assembly 76, well-known anchors 98*a*-98*h* (FIG. 3) secure perimeter end portions of the platen 90 to the drive assembly 76, where it is driven by the drive mechanism 82.

Figures 6, 6A:
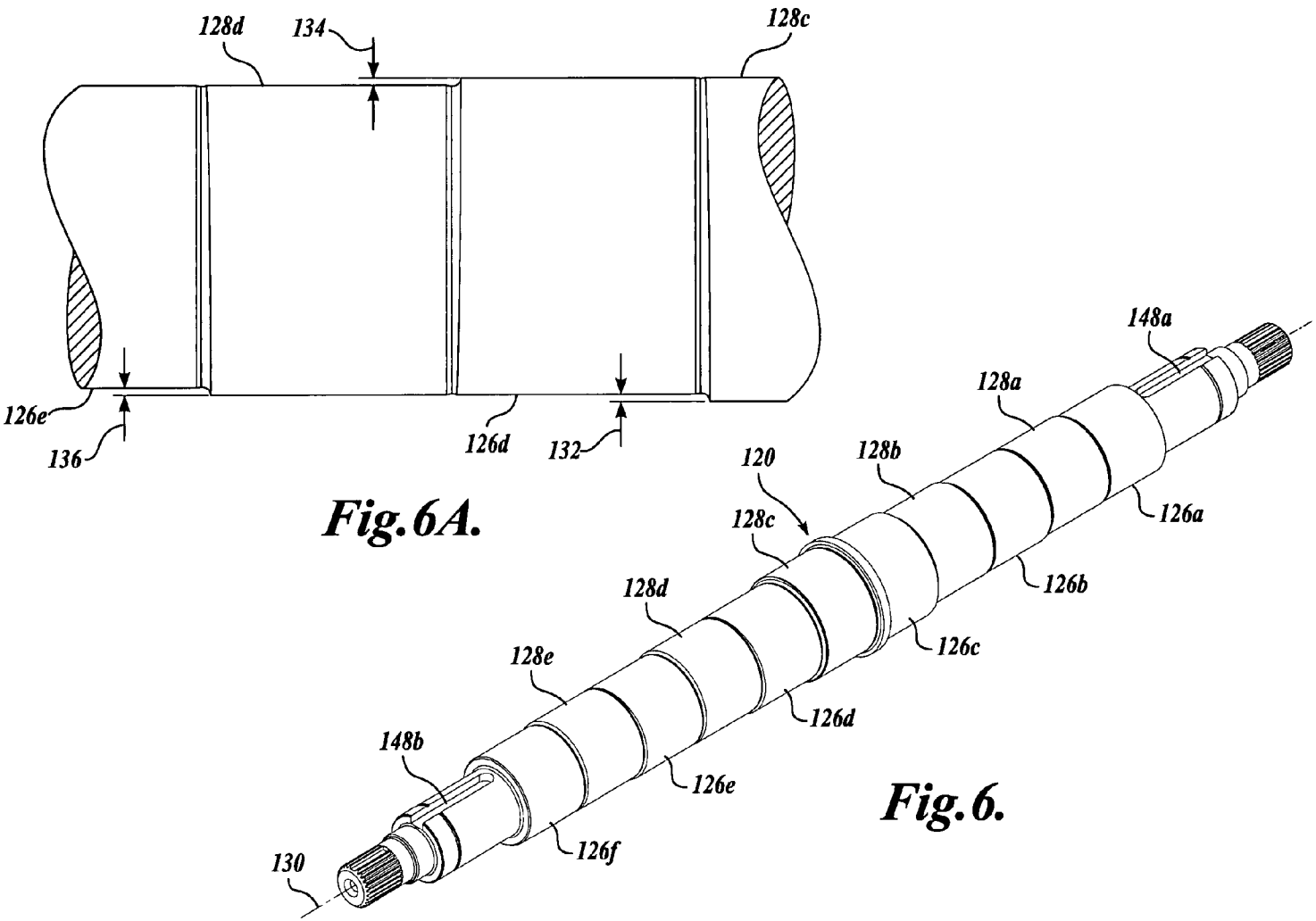
FIG. 6 is an isometric view of a shaft constructed in accordance with one embodiment of the present invention and usable with a drive mechanism of FIG. 5.
FIG. 6A is a side planar view amplifying a portion of the shaft of FIG. 6 and showing offsets between adjacent concentric and eccentric portions of the shaft.
Figure 7:
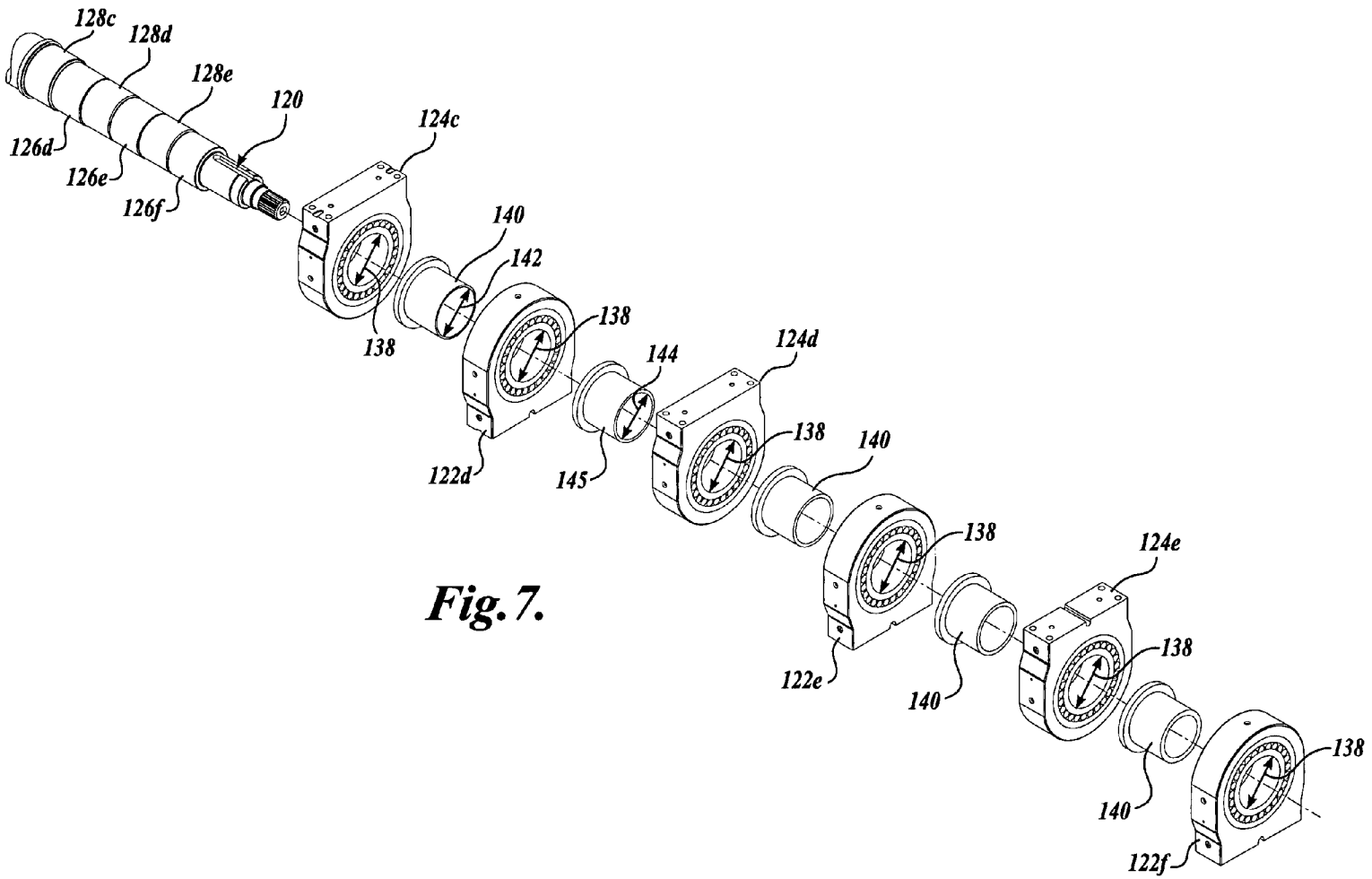
FIG. 7 is an isometric, partially exploded view of the drive mechanism of FIG. 5, showing various components of the drive mechanism.

The drive mechanism 82 may be best understood by referring to FIGS. 5-7. The drive mechanism 82 includes a shaft 120, a plurality of support bearing members 122*a*-122*f*, and a plurality of platen drive bearing members 124*a*-124*e*. Although a prescribed number of support bearing members 122*a*-122*f* and platen drive bearing members 124*a*-124*e* are illustrated, it should be apparent that a drive mechanism 82 having any number combination of support bearing members 122 and platen drive bearing members 124 is also within the scope of the present invention. Thus, a drive mechanism 82 having more or fewer support bearing members 122 and platen drive bearing members 124 is also within the scope of the present invention.

As may be best seen by referring to FIG. 6, the shaft 120 is suitably formed from any well-known, high strength material, such as steel, and includes a plurality of concentric portions 126*a*-126*f* and a plurality of eccentric portions 128*a*-128*e*. The concentric and eccentric portions are suitably integrally formed with the shaft 120 during manufacture of the shaft 120. The concentric and eccentric portions are disposed along a longitudinal axis 130 extending through the length of the shaft 120 and are disposed on the shaft 120 in an alternating fashion. As an example, the concentric and eccentric portions are disposed in an alternating fashion between the ends of the shaft 120, such that an eccentric portion is disposed between two concentric portions.

All of the concentric portions 126*a*-126*f* share a common axis of rotation during operation. Similarly, all eccentric portions 128*a*-128*e* share a second common axis of rotation, different from the axis of rotation of the concentric portions 126*a*-126*f*. This aspect is described in greater detail below with respect to FIGS. 8A-8C.

The axis of rotation of the eccentric portions 128*a*-128*e* is offset from the axis of rotation of the concentric portions 126*a*-126*f*. As best seen by referring to FIG. 6A, the eccentric portions 128*a*-128*e* have a circular cross-section and are offset from the circular cross-section of the concentric portions by an equal amount. Specifically, the eccentric portion 128*c* is positioned adjacent the concentric portion 126*d* and the axis of rotation of the eccentric portion 128*c* is off-set from the axis of rotation of the concentric portion 126*d* by an amount illustrated by the arrow 132.

Similarly, the eccentric portion 128*d* has an axis of rotation offset from the adjacent concentric portion 126*e* by an amount illustrated by the arrow 134. Finally, the axis of rotation of the eccentric portion 128*d* is offset from the axis of rotation of the adjacent concentric portion 126*f* by an amount illustrated by the arrow 136.

The alternating eccentric and concentric portions have an increasing diameter as viewed from the ends towards the middle of the shaft 120. This configuration accommodates support bearing members 122 and platen drive bearing members 124 of the same internal diameter to minimize cost and expense. It should be apparent that although a shaft 120 having such a configuration is preferred, other embodiments are also within the scope of the present invention.

As a non-limiting example, a shaft 120 having all eccentric portions of constant diameter and all concentric portions of a second diameter but different from the diameter of the eccentric portions is also within the scope of the present invention. In this non-limiting example, the use of well known split bearings sized to fit one of the eccentric or concentric portions may be utilized as support bearing members and platen drive bearing members. Thus, shafts 120 of different constructions are also within the scope of the present invention.

As may be best seen by referring to FIG. 7, the support bearing members 122 and platen drive bearing members 124 are mounted to the concentric portions 126 and eccentric portions 128, respectively, on bushings. In the partial view of FIG. 7, the support bearing members 122*d*-122*f* and the platen drive bearing members 124*c*-124*e* are well-known pillow blocks. Each one of the support bearing members 122 and platen drive bearing members 124 are identically configured and include an attachment opening of constant diameter represented by the arrow 138.

During assembly, support bearing members 122 are mounted on the concentric portion 126 and the corresponding land for each one of the bearing members 122 is positioned to be anchored to the housing 80. The housing 80 may, in turn, be anchored to a support footing (not shown) to absorb loads associated with operation of the press unit 20.

Each of the platen drive bearing members 124 are rotated 180° from the support bearing members 122 such that the land of each of the platen drive bearing members 124 is positioned to be coupled to the platen 90 in a manner described above. The support bearing members 122 and platen drive bearing members 124 are seated on corresponding eccentric or concentric portion on bushing 140. For ease of manufacture, the thickness of each cylindrical portion of each bushing 140 is dimensioned to accommodate the sizing requirements of the shaft 120.

Specifically, and as an example, the bushing 140 is sized to be received within the attachment opening of the platen drive bearing member 124*c*. The attachment opening has a diameter (indicated by the arrow 138) large enough to be slidably received on the shaft 120, such that it fits snugly on the outside diameter of the eccentric portion 128*c*. The attachment opening is large enough to pass freely over all of the other concentric and eccentric portions during its path of travel along the shaft 120.

Similarly, the bushing 145 is sized to be received within the support bearing member 122*d*. The bushing 145 has an opening 144 sized to be received on the outside diameter of the concentric portion 126*d* but is smaller than the outside diameter of eccentric portion 128*c*. However, the inside diameter of the opening 144 slides freely over all other eccentric and concentric portions of the shaft 120. As noted above, this design permits the use of identical support bearings members 122 and platen drive bearing members 124.

Figure 5A:
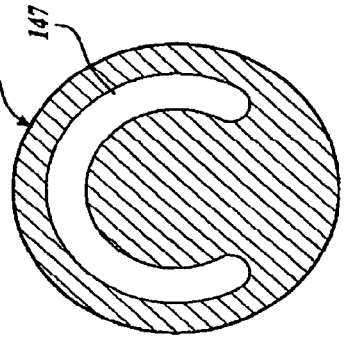
FIG. 5A is an end planar view of an end cap for the drive assembly taken substantially through Section 5A-5A of FIG. 5.

As assembled, each of the support bearing members 122*a*-122*f* and platen drive bearing members 124*a*-124*e* are secured to the shaft 120 by well-known end caps 146*a* and 146*b*. As seen in FIG. 5A, each end cap 146*a* and 146*b* is sized and configured to act as a counterbalance to the platen 90 during operation of the press unit 20. The end caps 146*a* and 146*b* are suitably formed from a solid piece of high strength material, such as aluminum. The interior is machined to created a substantially C-shaped channel 147 extending substantially the entire length of the end cap. By the inclusion of the channel 147 in the end caps, the end caps 146*a* and 146*b* act as a counterbalance to the platen 90 during operation. Specifically, the end caps 146*a* and 146*b* are mounted to respective ends of the shaft 120, such that the closed end of the channel 147 is located nearest the platen 90.

Referring back to FIG. 5, the ends of the end caps 146*a* and 146*b* also include an optional mass adjustment assembly 149. The mass adjustment assembly 149 is a pair of opposed prongs. The prongs are sized and configured to receive corresponding mass plates (not shown) to permit selective addition of mass to the end caps 146*a* and 146*b* to selectively adjust the counterbalancing characteristics of the end caps 146*a* and 146*b*.

Each of the end caps are keyed to the shaft 120 by a protrusion (not shown) formed within an internal cavity of the end cap. The protrusion of the end caps is sized to be received within a corresponding notch 148*a* and 148*b* formed in respective ends of the shaft 120. The assembled drive mechanism 82 is then disposed within the housing 80 and connected to the drive motors 64 in a manner well-known in the art.

Figures 8A, 8B, 8C:
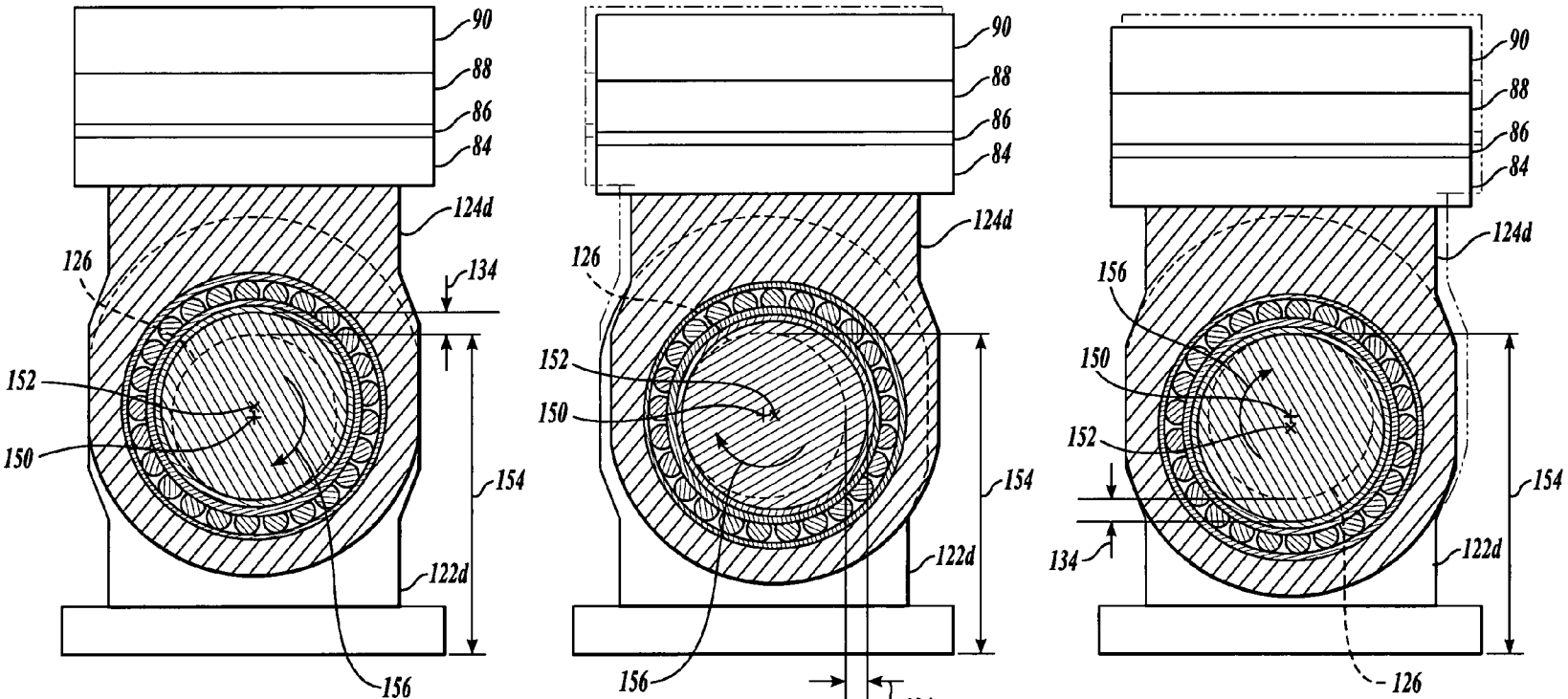
FIG. 8A is an end view of the press unit of FIG. 3, showing the press unit in an extended position during normal operations of the press unit.
FIG. 8B is an end planar view of the press unit of FIG. 8A and showing the press unit in a mid-lift position during operation of the press unit.
FIG. 8C is an end planar view of the press unit of FIG. 8A and showing the press unit in a fully retracted position during normal operating conditions of the press unit.

Operation of the press unit 20 may be best understood by referring to FIGS. 8A-8C. It should be apparent that FIGS. 8A-8C are sequential cross-sectional end planar views of a portion of the drive mechanism 82 during operation to illustrate sequential movements of the press unit 20. For ease of illustration and clarity in understanding movement of various components of the press unit 20, certain dimensions have been exaggerated and, therefore, illustrated spacing is not intended to be limiting.

As described above, the concentric portions 126*a*-126*f* rotate about a constant axis of rotation, referred to as a concentric axis of rotation 150. As also described above, the eccentric portions 128*a*-128*e* rotate about a second axis of rotation, known as an eccentric axis of rotation 152. However, as the drive motors 64 rotate the shaft 120, and due to the offset (indicated by arrows 134), the eccentric axis of rotation 152 rotates around the concentric axis of rotation 150.

As driven, the drive assembly 76 moves in a non-linear motion. To better illustrate this motion, and still referring to FIGS. 8A-8C, assume that the drive motors 64 turn the shafts 120 in a clockwise direction about the concentric axis of rotation 150 and as indicated by the arrow 156. As driven, the concentric portion 126 rotates about the concentric axis of rotation 150, such that it remains a fixed distance from the base of the housing 80 and indicated by the arrow 154 throughout the operation cycle of the press unit 20.

At the same time, however, due to the offset distance 134, the eccentric axis of rotation 152 of the eccentric portions 128 rotates about the concentric axis of rotation 150 to drive the platen 90 from a fully extended position (FIG. 8A) to a mid-position (FIG. 8B), and finally to a fully retracted or down position (FIG. 8C). As the drive motors 64 continue to drive the press unit 20, the platen 90 is returned to the fully extended position (FIG. 8A). Thus, the drive motors 64 drive the drive assembly 76 between a fully extended position, to a fully retracted position, and returns back to the fully extended position. This type of motion drives the platen 90 in a substantially non-linear motion, such as circular.

A press unit 20 constructed in accordance with the various embodiments of the present invention provides a compact and highly reliable alternative to existing press units. While the preferred embodiment of the invention has been illustrated and described, it will be appreciated that various changes can be made therein without departing from the spirit and scope of the invention.

The invention claimed is:

1. A press unit for a manufactured wood product press, the press unit comprising:

(a) a housing;

(b) a platen exterior to the housing;

(c) a first drive assembly disposed within the housing and coupled to the platen, the first drive assembly comprising a drive mechanism including (i) a shaft having at least one concentric portion disposed along a length of the shaft and at least one eccentric portion disposed along the length of the shaft and rotating about separate axes; (ii) a support bearing member extending from the at least one concentric portion; and (iii) a platen drive bearing member extending between the at least one eccentric portion and the platen;

wherein rotation of the eccentric portion about the eccentric portion's axis causes movement of the platen in a substantially circular path.

2. The press unit of claim 1, wherein the drive assembly comprises a support bearing member coupled to the concentric portion.

3. The press unit of claim 1, wherein the drive assembly comprises a platen drive bearing member coupled to the eccentric portion, wherein the platen drive bearing member supports the platen.

4. The press unit of claim 1, wherein the shaft has a plurality of alternating concentric and eccentric portions disposed along a length of the shaft wherein rotation of the eccentric portions causes movement of the platen in a substantially circular path.

5. The press unit of claim 4, further comprising a second drive assembly mechanism disposed within the housing and coupled to the platen to drive the platen relative to the housing in at least a non-linear motion.

6. A press unit for manufactured wood product press, the press unit comprising:

(a) a platen; and (b) first and second drive assemblies coupled to a face of the platen; the first and second drive assemblies each comprising:

(i) a housing;

(ii) a drive mechanism disposed within the housing, the drive mechanism having a shaft and both one concentric portion and one eccentric portion located on separate axes along the shaft wherein movement of the eccentric portion causes non-linear movement of the platen.

7. The press unit of claim 6, wherein the drive mechanism includes a plurality of alternating eccentric and concentric portions.

8. The press unit of claim 6, wherein the shaft includes additional eccentric and concentric portions along a length of the shaft wherein the additional eccentric and concentric portions are alternating along the shaft.

9. The press unit of claim 8, further comprising a platen drive bearing member coupled to each of the eccentric portions.

10. The press unit of claim 9, further comprising a support bearing member coupled to each of the concentric portions.

11. A press unit for a manufactured wood products press, the press unit comprising:

(a) a platen;

(b) a housing connected to a face of the platen; and (c) a drive assembly disposed within the housing, the drive assembly including a shaft disposed within the housing for rotational motion relative to a longitudinal axis extending through a length of the shaft, and further comprising a drive mechanism having alternating eccentric and concentric portions rotating about separate axes along the shaft, wherein actuation of the drive mechanism forces movement of the platen in at least a non-linear motion.

12. The press unit of claim 11, wherein the alternating eccentric and concentric portions are located on the shaft.

13. The press unit of claim 12, further comprising a plurality of platen bearing members, wherein one of the plurality of platen bearing members is disposed on each one of the eccentric portions.

14. The press unit of claim 13, further comprising a plurality of support bearing members, wherein one of the plurality of support bearing members is disposed on each one of the concentric portions.

15. A press unit for a manufactured wood products press, the press unit comprising:

(a) a housing;

(b) a rotatable shaft disposed within the housing, the rotatable shaft having a first end and a second end, the first and second ends being axially aligned and defining a first axis of rotation, the shaft further comprising a plurality of concentric cylindrical segments aligned on the first axis of rotation and a plurality of eccentric cylindrical segments aligned on a parallel offset axis;

(c) a first plurality of bearing assemblies supportably connected to the concentric cylindrical segments and fixedly attached to the housing; and (d) a second plurality of bearing assemblies supportably connected to the eccentric cylindrical segments and adapted to be fixedly attached to a platen such that rotating the rotatable shaft will cause the platen to move along a substantially circular path of travel.

* * * * *